US011826894B2

(12) United States Patent
Fu et al.

(10) Patent No.: US 11,826,894 B2
(45) Date of Patent: Nov. 28, 2023

(54) TOOL BAR

(71) Applicant: Tangshan Changzhi Agricultural Tools Design Manufacturing Co., Ltd., Hebei (CN)

(72) Inventors: Changzhi Fu, Hebei (CN); Xiaolin Fu, Hebei (CN); Yuxuan Fu, Hebei (CN); Chun Li, Hebei (CN); Dongjian Jin, Hebei (CN); Xiongjun Ren, Hebei (CN)

( * ) Notice: Subject to any disclaimer, the term of this patent is extended or adjusted under 35 U.S.C. 154(b) by 366 days.

(21) Appl. No.: 17/034,792

(22) Filed: Sep. 28, 2020

(65) Prior Publication Data

US 2021/0387321 A1 Dec. 16, 2021

(30) Foreign Application Priority Data

Jun. 10, 2020 (CN) ..... 202021049689.4
Aug. 10, 2020 (CN) ..... 202021637950.2
Aug. 10, 2020 (CN) ..... 202021638292.9

(51) Int. Cl.
*B25G 3/14* (2006.01)
*B25G 3/28* (2006.01)
*B25G 3/30* (2006.01)
*B25G 3/04* (2006.01)

(52) U.S. Cl.
CPC ..... *B25G 3/14* (2013.01); *B25G 3/28* (2013.01); *B25G 3/30* (2013.01); *B25G 3/04* (2013.01)

(58) Field of Classification Search
CPC ... B25G 3/14; B25G 3/28; B25G 3/30; B25G 3/04
See application file for complete search history.

(56) References Cited

U.S. PATENT DOCUMENTS 5,161,278 A * 11/1992 Tomm ..... A46B 5/0095 15/159.1
5,433,551 A * 7/1995 Gordon ..... B05C 17/0205 403/368
5,649,780 A * 7/1997 Schall ..... B25G 1/04 403/109.5
5,692,856 A * 12/1997 Newman, Jr. ..... B25G 1/04 403/109.5
6,761,274 B1 * 7/2004 Chen ..... A47B 45/00 403/109.1
7,044,860 B2 * 5/2006 Smith ..... F16C 3/035 403/109.5
2016/0288311 A1 * 10/2016 Ferris ..... B25D 1/00

* cited by examiner

*Primary Examiner* — Eric A. Gates
*Assistant Examiner* — Reinaldo A Vargas Del Rio

(57) ABSTRACT

Disclosed is a tool bar. The tool bar comprises a head part, a tail part, a pipe connection assembly, a backstop mechanism and a bushing member. The head part and the tail part are connected with each other by the pipe connection assembly. The bushing comprises a cone section and a cylinder section; one end of the head part passes through the cylinder section and connected to an inner thread of the cone section; the outer side of the cone section is configured to secure with a tool head; an external thread is provided on an outer surface of the cylinder section. The backstop mechanism comprises an intermediate member and a lock cap; the intermediate member is a hollow cylinder.

3 Claims, 9 Drawing Sheets

TOOL BAR

CROSS-REFERENCE TO RELATED APPLICATIONS

This application claims priority to Chinese Application No. 202021637950.2, filed on Aug. 10, 2020, entitled "Shank Installation Assembly for Tool Bar," No. 202021049689.4, filed on Jun. 10, 2020, entitled "Tool Bar with Backstop Mechanism," and No. 202021638292.9, filed on Aug. 10, 2020, entitled "Pipe Connection Assembly". These contents are hereby incorporated by reference.

TECHNICAL FIELD

The present disclosure relates to the field of hand tools, especially to a tool bar.

BACKGROUND

While people are pursuing the quality of life, the storage space of the family or unit is becoming more and more insufficient. With the importance of hand tools in the work of agriculture and gardening, multi-purpose tools and convenient quick-release tools are becoming more and more popular with people. With the rise of e-commerce, the shipping cost of a single piece of goods is more related to the length, size, and packaging consumption of the item. Therefore, quick-release tools that able to be assembled/disassembled are becoming more and more popular, especially the screw-on tool handles. That is, the tool head and the tool bar body are attached through a thread pair. A tool bar can not only be divided into two or more sections, but also can match multiple tool heads, which has a wider range of applications and strong versatility.

However, the threaded connection part between the tool head and the tool bar may loosen and retreat after a long-time use. That is, after a long-time use, due to the force, the threaded part of the connection part will becoming loosen, which not only affects the work efficiency, but also seriously affects the service life of the tool. Although the tool bar can be replaced in time, it increases the later use cost and brings an economic burden.

In addition, the tool handles of the existing hand tools are in various forms. In order to meet the needs of different users' height or working environment, the tool bar body is usually made of a length-adjustable structure. The traditional length-adjustable bar is a telescopic rod which having parts that slide one within another. The telescopic part of this kind of telescopic rod needs to be provided with a limit component, and its strength is generally low. During long-term use, the rod body is prone to bending and breaking, which not only affects work efficiency, but also causes personal injury to the user. The limit component of the telescopic rod is easy to damage, frequent maintenance, which seriously affects the work progress, and the upper end of the existing hand tool bar is equipped with a handshake. The common handshake includes the upper handshake head and the lower handshake sleeve. The handshake head is divided into T-shaped Handshake and triangle handshake, the connection between them and the rod is roughly divided into the following two types:

The first one is to directly screw the handshake on the upper end of the rod through the threads on the inner wall of the lower cylinder of the handshake. Although this is a simple connection, it cannot be guaranteed the parallel between the load-bearing surface of the handshake and the load-bearing surface of the tool after tightening. If the deviation angle is large, the assembled tools may not be used normally. When the deviation angle is close to or reaches 90°, the tools cannot be used, and the phenomenon of disengagement and looseness will occur.

The second one is to assemble the lower cylinder body and the upper end of the rod body concentrically and then secure these two through a connecting piece provided on the side wall. In the current e-commerce, the cost of transportation and delivery is very much related to the volume. Such connection cannot be disassembled randomly, and its length cannot be adjusted during the transportation process, which accumulates the cost. The cost burden will significantly and negatively affect the online sale of this product.

SUMMARY OF THIS DISCLOSURE

The present disclosure aims to solve the impracticality problem of the market available tool bar. After a long-time use, the threaded connection part between the tool head and the tool rod often becomes loose and reversed, and the rod body is easy to bend and break. Accordingly, one of the objects of the present disclosure is to provide a tool bar.

In order to solve the above technical problem, an embodiment of the present disclosure provides a tool bar, which comprises a head part, a tail part, a pipe connection assembly, a backstop mechanism and a bushing member; the head part and the tail part are connected with each other by the pipe connection assembly.

The bushing comprises a cone section and a cylinder section. One end of the head part passes through the cylinder section and connected to an inner thread of the cone section. The outer side of the cone section is configured to secure with a tool head. An external thread is provided on an outer surface of the cylinder section.

The backstop mechanism comprises an intermediate member and a lock cap. The intermediate member is a hollow cylinder.

The lock cap is a hollow cylindrical structure, with an internal thread provided on an inner wall of the lock cap at one end, and a shoulder provided at an end mouth on the other end.

The intermediate member is fitted into an interior of the lock cap. The intermediate member and the lock cap together are fitted over the head part. The intermediate member tightly abuts against an outer surface of the head part. The internal thread on the lock cap is coupled with the external thread on the cylinder section. The shoulder abuts against an outer end face of the intermediate member.

The pipe connection assembly comprises an inner bush, an outer bush, a lock bush and an intermediate bush.

The inner bush comprises a first diameter bush and a second diameter bush, wherein the first diameter bush has a greater diameter than the second diameter bush. The first diameter bush is connected to one end of the bushing member away from the head part. One end of the outer bush is connected to one end of the tail part.

The intermediate bush is fitted over the second diameter bush. The outer bush is fitted over the second diameter bush. An end face of the outer bush is jointed with an end face of the intermediate bush. The lock bush is fitted over the intermediate bush and the outer bush. An end of the lock bush is connected to the outer bush by thread connection. A stop collar is provided on the intermediate of the inner wall of the lock bush. When the lock bush is fitted over the intermediate bush and the outer bush, the stop collar is located between the intermediate bush and the first diameter bush.

In some embodiments, a stop step is provided on an inner surface of the intermediate member. A plurality of open notch is provided on a side wall of the intermediate member. The open notches are spaced along the circumference of the side wall of the intermediate member and extend from the end to the center. A plurality of elongate plane is provided on the outer surface of the head part corresponding to the intermediate member. The elongate plane is matched with the stop step.

In some embodiments, a first teeth is provided on an outer end face of the cylinder section along the circumference of the cylinder section; a second teeth is provided on an inner end face of the intermediate member facing toward the cylinder section. The lock cap is thread connected with the cylinder section. The second teeth is coupled with the first teeth.

In some embodiments, a spline is arranged around the circumference of the outer surface of the second diameter bush. A spline groove corresponding to the spline is provided on the inner wall of the intermediate bush.

In some embodiments, the outer bush is a hollow sleeve shaped like a ladder. A first section with greater diameter is a retainer ring, and a second section with smaller diameter is the bush body. The bush body is inserted into one end of the tail part. The retainer ring is located outside the tail part. An end face of the retainer ring is provided with an intermediate teeth. An external thread is provided on the outer surface of the retainer ring for connecting with the lock bush.

In some embodiments, the pipe connection assembly further comprises a head block and a tail block. The head block is inserted into one end of the head part away from the bushing member. The first diameter bush is connected to the head part passing through the head block. The tail block is inserted into one end of the tail part. The bush body is connected to the tail body passing through the tail block.

In some embodiments, the tool bar further comprises a shank and a shank installation assembly. The shank installation assembly comprises a nut seat, a stop seat and a screw.

The nut seat is a structure with a blind hole in the center.

A groove structure which has clubs-shaped cross section is provided on a bottom center of the blind hole. The groove wall of the groove structure comprises an arc groove section recessed radially outward and a curved convex section protruding radially inward. The arc groove section is matched with the curved convex section.

The stop seat is a circular sheet. A plurality of stop pillars are arranged on a bottom surface of the stop seat. Each of the stop pillar is matched with the arc groove section. A through hole is provided on the center of the stop seat.

One end of the screw is provided with thread, the other end is provided with a nut.

The screw is located on the stop seat passing through the through hole. The nut of the screw is inserted into the center of the groove structure. The stop pillar on the stop seat is inserted into the arc groove section. The stop seat limits the nut within the groove structure. The thread end of the screw passes through the shank and is connected to one end of the tail part away from the pipe connection assembly.

In some embodiments, the stop pillar is glued with the arc groove section. A side wall of the nut is glued and secured with the curved convex section.

In some embodiments, the tool bar further comprises a stop bush. The stop bush is located on one end of the tail part away from the pipe connection assembly. A anti-retraction ring is provided at a lower part of the shank. Both the end face of the anti-retraction ring facing the stop bush and the end face of the stop bush facing the anti-retraction ring are provided with a anti-retraction teeth which is able to couple with each other. The thread end of the screw, in sequence, passes through the shank and the anti-retraction ring to connect to the stop bush.

In some embodiments, a skidproof pattern is provided on the outer surface of the nut seat.

Compared with the prior art, the tool bar provided in the present disclosure has a bushing member for connecting (weld connection or secure connection with connecting member) the tool head. The bushing member is in thread connection with the head part which allows the head part to connect with the tool head with thread, providing a quick-release and universal solution. Furthermore, a backstop mechanism is introduced in the present disclosure. The intermediate member in the backstop mechanism is hugged on the outer surface of the head part. After the internal thread on the lock cap and the external thread of the cylinder section are screwed together, the shoulder can bear against the outer end face of the intermediate member to act as an axial limit. In conjunction with the threaded connection between the lock cap and the cylinder section, it can adjust the position between the head part 1 and the bushing member. The relationship is limited to effectively prevent the phenomenon of loosening and slippage between the threaded connections, improve the overall service life of the tool, and improve work efficiency. The pipe connection assembly can be applied to tool bars that need to be length adjustable. First, installing inner bush on the head part with different lengths, installing the outer bush on the tail part with different lengths; and then according to the required length, selecting the appropriate head part and tail part for assembling. When assembling, putting the intermediate bush on the second diameter bush of the inner bush, and putting the outer bush on the second diameter bush of the inner bush, and make the end face of the outer bush fit the end face of the intermediate bush. The lock bush is fitted over the outside of the intermediate bush and the outer bush, and the end of the lock bush and the outer bush are connected by threads. After the lock bush is fitted over the intermediate bush and the outer bush, the stop collar on the inner wall of the lock bush is located between the intermediate bush and the first diameter bush of the inner bush. Under the action of the intermediate bush and the lock bush, the connection between the inner bush and the outer bush connects the head part and the tail part together. This structure makes the tool bar easy for assemble, adjust, store and transport, and the strength of the joint between the bar is increased, having strong stability, low maintenance rate and low cost.

Figure 1:
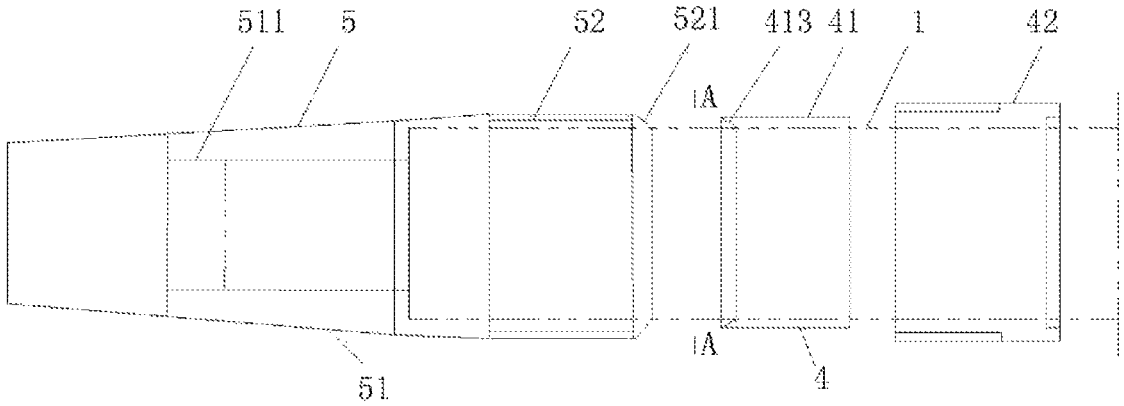
FIG. 1 is an exploded view showing the backstop mechanism and bushing member of the tool bar according to one embodiment of the present disclosure.

In the drawings: 1, head part; 11, elongate plane;

2, tail part;

3, pipe connection assembly;

31, inner bush; 311, first diameter bush;

312, second diameter bush; 3121, spline;

32, outer bush; 321, retainer ring; 3211, teeth of anti-retraction ring; 322, bush body;

33, lock bush; 331, stop collar;

34, intermediate bush; 341, spline groove; 342, teeth of intermediate bush; 343, notch;

35, head block; 36, tail block; 3*a*, block body; 3*b*, shrinking notch;

4, stop mechanism; 41, intermediate member; 411, stop step; 412, open notch; 413, second teeth; 42, lock cap;

5, bushing member; 51, cone section; 511, lock nut; 52, cylinder section; 521, first teeth;

6, shank; 61, anti-retraction ring;

7, shank installation assembly;

71, nut seat; 711, groove structure; 7112, arc groove section; 7113, curved convex section; 712, skidproof pattern;

72, stop seat; 721 stop pillar; 722, through hole;

73, screw; 731, screw nut;

8, stop bush; 81, stop nut.

DETAILED DESCRIPTION OF THE DISCLOSURE

In order to specify the technical problems, technical solutions, and beneficial effects solved by the present disclosure, the following further describes the present disclosure in detail with reference to the accompanying drawings and embodiments. It should be understood that the specific embodiments described herein are only used to explain the present disclosure, but not to limit the present invention.

As shown in FIGS. 1-11, the tool bar provided in the embodiments of the present disclosure comprises a head part 1, a tail part 2, a pipe connection assembly 3, a backstop mechanism 4 and a bushing member 5. The head part 1 is connected to the tail part 2 via the pipe connection assembly 3.

Referred to FIG. 1, the bushing member 5 comprises a cone section 51 and a cylinder section 52. One end of the head part 1 passes through the cylinder section 52 and connected to an inner thread of the cone section 51. The outer side of the cone section 51 is configured to secure with a tool head (not shown). An external thread is provided on an outer surface of the cylinder section 52. The head tool may include any of a spade, a hoe, a pick, a fork, etc., and the preset disclosure is not limited here. The bushing member 5 and the tool head can be integrally formed, or are secured together by welding, riveting, or bolt connection. The secure manner is not limited here.

The backstop mechanism 4 comprises an intermediate member 41 and a lock cap 42. The intermediate member 41 is a hollow cylinder.

The lock cap 42 is a hollow cylindrical structure, with an internal thread provided on an inner wall of the lock cap at one end, and a shoulder (not shown) provided at an end mouth on the other end.

The intermediate member 41 is fitted into an interior of the lock cap 42. The intermediate member 41 and the lock cap 42 together are fitted over the head part 1. The intermediate member 41 tightly abuts against an outer surface of the head part 1. The internal thread on the lock cap 42 is coupled with the external thread on the cylinder section 52. The shoulder abuts against an outer end face of the intermediate member 41.

Figure 5:
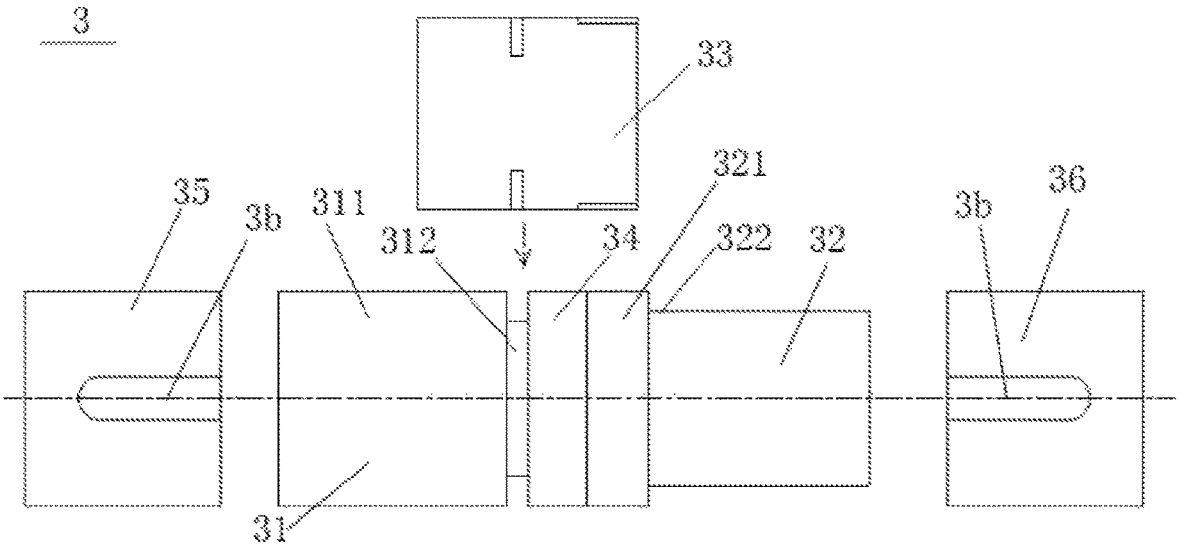
FIG. 5 is an exploded view of the pipe connection assembly of the tool bar according to one embodiment of the present disclosure.
Figure 6:
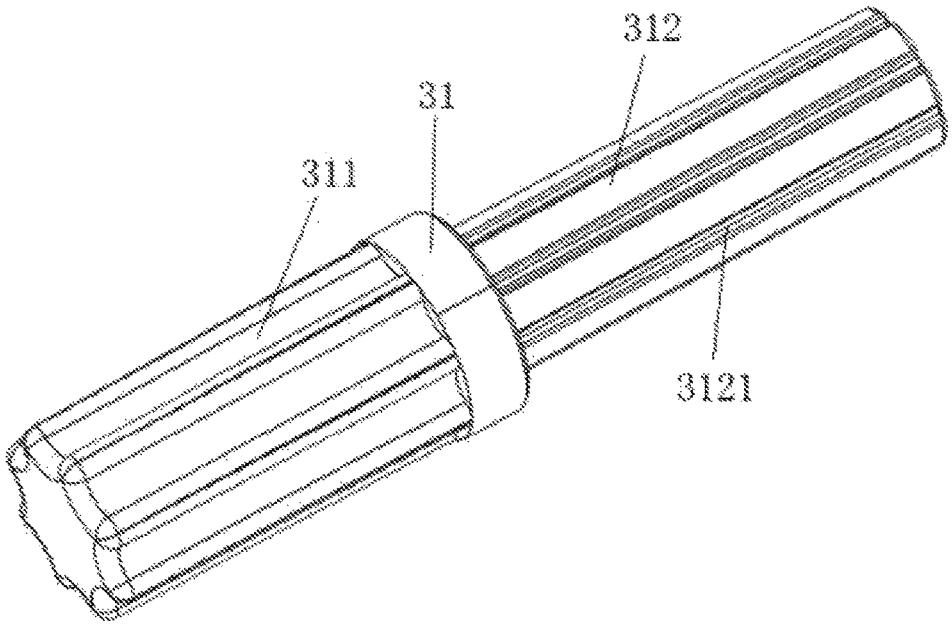
FIG. 6 is a schematic diagram showing the inner bush in FIG. 5.

As shown in FIGS. 5-6, the pipe connection assembly 3 comprises an inner bush 31, an outer bush 32, a lock bush 33 and an intermediate bush 34.

The inner bush 31 comprises a first diameter bush 311 and a second diameter bush 312 which are connected coaxially, wherein the first diameter bush 311 has a greater diameter than the second diameter bush 312. The first diameter bush 311 is connected to one end of the bushing member 5 away from the head part 1. One end of the outer bush 32 is connected to one end of the tail part 2. The connection between the first diameter bush 311 and the end of the head part 1 away from the bushing member 5 may be adhesive fixation. The connection between one end of the outer bush 32 and the tail part 2 may be adhesive fixation. Alternatively, a nut is provided on the end of the head part 1 away from the bushing member 5, and then the first diameter bush 311 is screwed to the nut. There is not limit for the connection between the first diameter bush 311 and the end of the head part 1 away from the bushing member 5, and the connection between one end of the outer bush 32 and one end of the tail part 2.

The intermediate bush 34 is fitted over the second diameter bush 312. The outer bush 32 is fitted over the second diameter bush 312. An end face of the outer bush 32 is jointed with an end face of the intermediate bush 34. The lock bush 33 is fitted over the intermediate bush 34 and the outer bush 32. An end of the lock bush 33 is connected to the outer bush 32 by thread connection. A stop collar 331 is provided on the middle of the inner wall of the lock bush 33. When the lock bush 33 is fitted over the intermediate bush 34 and the outer bush 32, the stop collar 331 is located between the intermediate bush 34 and the first diameter bush 311. Wherein both the bushing member 5 and the inner bush 31 are solid members acting as extensions, respectively.

Compared with the prior art, the tool bar provided in the present disclosure has a bushing member 5 for connecting (weld connection or secure connection with connecting member) the tool head. The bushing member 5 is in thread connection with the head part 1 which allows the head part 1 to connect with the tool head with thread, providing a quick-release and universal solution. Furthermore, a backstop mechanism 4 is introduced in the present disclosure. The intermediate member 41 in the backstop mechanism 4 is hugged on the outer surface of the head part 1. After the internal thread on the lock cap 42 and the external thread of the cylinder section 52 are screwed together, the shoulder can bear against the outer end face of the intermediate member 5 to act as an axial limit. In conjunction with the threaded connection between the lock cap 42 and the cylinder section 52, it can adjust the position between the head part 1 and the bushing member 5. The relationship is limited to effectively prevent the phenomenon of loosening and slippage between the threaded connections, improve the overall service life of the tool, and improve work efficiency. The pipe connection assembly 3 can be applied to tool bars that need to be length adjustable. First, installing inner bush 31 on the head part 1 with different lengths, installing the outer bush 34 on the tail part 2 with different lengths; and then according to the required length, selecting the appropriate head part 1 and tail part 1 for assembling. When assembling, putting the intermediate bush 34 on the second diameter bush 312 of the inner bush 31, and putting the outer bush 32 on the second diameter bush 312 of the inner bush 31, and make the end face of the outer bush 32 fit the end face of the intermediate bush 34. The lock bush 33 is fitted over the outside of the intermediate bush 34 and the outer bush 32, and the end of the lock bush 33 and the outer bush 31 are connected by threads. After the lock bush 33 is fitted over the intermediate bush 34 and the outer bush 32, the stop collar 331 on the inner wall of the lock bush 33 is located between the intermediate bush 34 and the first diameter bush 311 of the inner bush 31. Under the action of the intermediate bush 34 and the lock bush 33, the connection between the inner bush 31 and the outer bush 32 connects the head part 1 and the tail part 2 together. This structure makes the tool bar easy for assemble, adjust, store and transport, and the strength of the joint between the bar is increased, having strong stability, low maintenance rate and low cost.

In some embodiments, as shown in FIG. 1, a lock nut 511 is secured to the interior of the cone section 51. One end of the head part 1 passes through the cylinder section 52 and screwed with the lock nut 511.

In some embodiments, a metal sleeve is fitted over the bushing member 5. The metal sleeve is shaped to match with the bushing member 5. Preferably, the metal sleeve is shaped to match with the cone section of the bushing member 5. The metal sleeve is inserted into the connecting hole of the tool head along with the bushing member 5, and a connecting piece (not shown) is used to joint the metal sleeve and the tool head.

Figure 2:
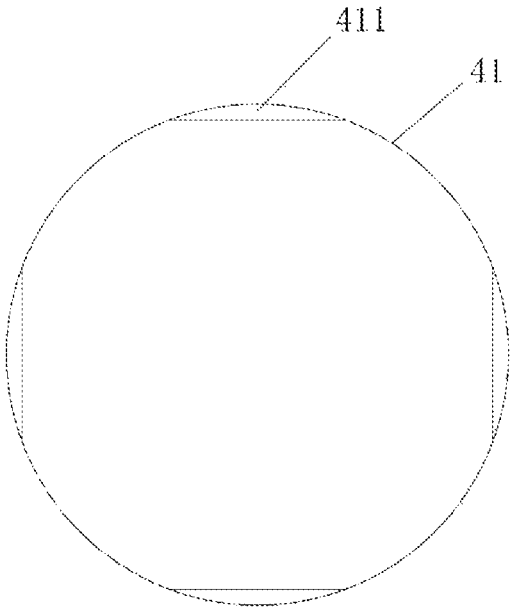
FIG. 2 is a schematic diagram showing one of the side views of the intermediate member in FIG. 1.
Figure 3:
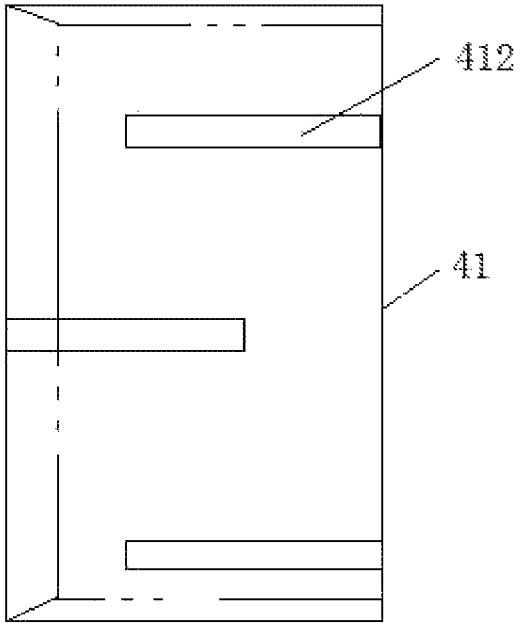
FIG. 3 is a schematic diagram showing another side view of the intermediate member in FIG. 1.
Figure 4:
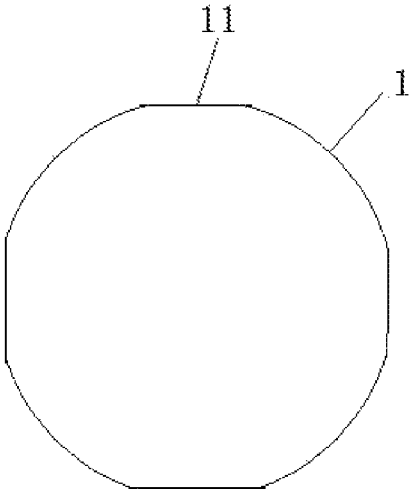
FIG. 4 is a cross sectional view from A-A in FIG. 1.

In some embodiments, as shown in FIGS. 2-4, a stop step 411 is provided on an inner surface of the intermediate member 41. A plurality of open notch 412 is provided on a side wall of the intermediate member 41. The open notches 412 are spaced along the circumference of the side wall of the intermediate member 41 and extend from the end to the center. A plurality of elongate plane 11 is provided on the outer surface of the head part 1 corresponding to the intermediate member 41. The elongate plane 11 is matched with the stop step 411. The arrangement of the open notch allows the intermediate member 41 to expand its diameter and enhance the adhesion with other components, which increases the universal of the intermediate member 41, and may be adapted to various head part 1 with different diameter. The stop step 411 and the elongate plane 11 provides a circumference stop when the intermediate 41 is fitted over the head part 1.

The position, shape, and number of the stop step 411 and the elongate plane 11 are matched. In the present embodiment, the stop step and the elongate plane have four rectangular planar structures, and the open notches 412 on the intermediate member 41 extend toward the center of the intermediate member 41 from two end faces in axial direction. And the open notch are in a rectangular notch shape. The length of the open notch 412 is ½-⅔ of the overall length of the intermediate member 41. The open notches in the two extending directions are spaced, and two adjacent open notches are directionally reversed. Preferably, the number of open notches is 4-8.

In some embodiments, a first teeth 521 is provided on an outer end face of the cylinder section 52 along the circumference of the cylinder section 52; a second teeth 413 is provided on an inner end face of the intermediate member 41 facing toward the cylinder section 52. The lock cap 42 is thread connected with the cylinder section 52. The second teeth 413 is coupled with the first teeth 521 for being a circumferential limiter. The second teeth 413 and the first teeth 521 are either straight teeth or oblique teeth. The first teeth 521 and the second teeth 413 are coupled and being a limiter. Preferably, the first teeth 521 and the second teeth 413 are straight teeth.

In some embodiments, the length of the lock cap 42 is less than the sum of the length of the cylinder section 52 and the length of the intermediate member 41.

In some embodiments, a skidproof pattern is provided on the outer surface of the lock bush 33 to facilitate screwing the lock bush 33.

Figure 8:
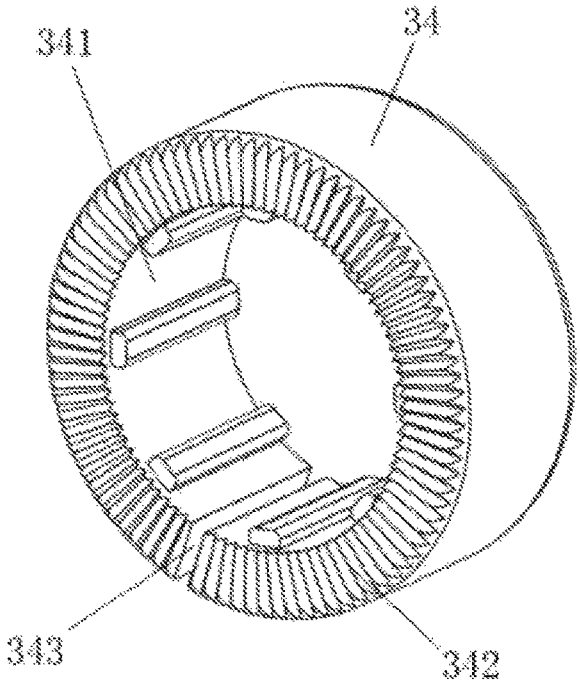
FIG. 8 is a schematic diagram showing the intermediate bush in FIG. 5.
Figure 9:
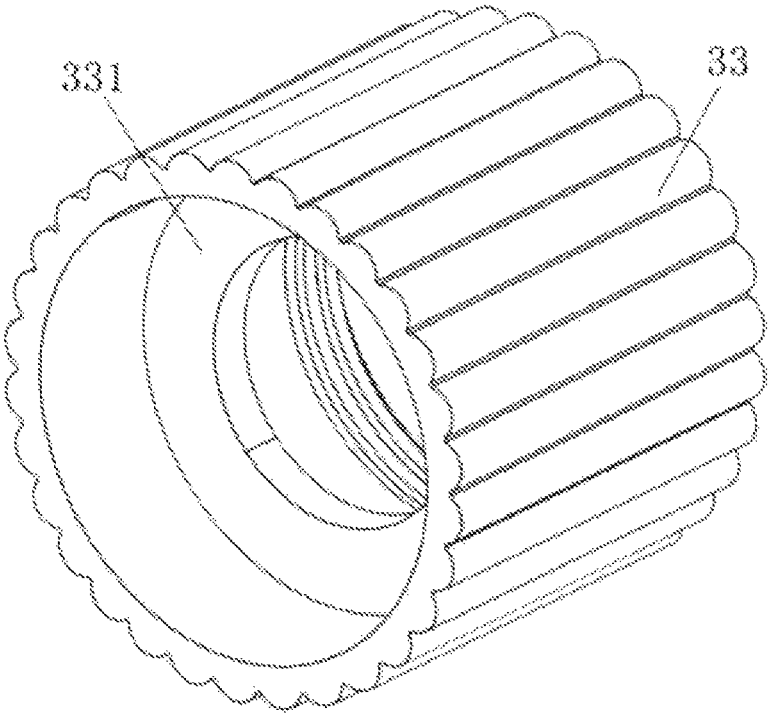
FIG. 9 is a schematic diagram showing the lock bush in FIG. 5.

In some embodiments, as shown in FIGS. 6 and 8, a spline 3121 is arranged around the circumference of the outer surface of the second diameter bush 312. A spline groove 341 corresponding to the spline 3121 is provided on the inner wall of the intermediate bush 34.

Figure 7:
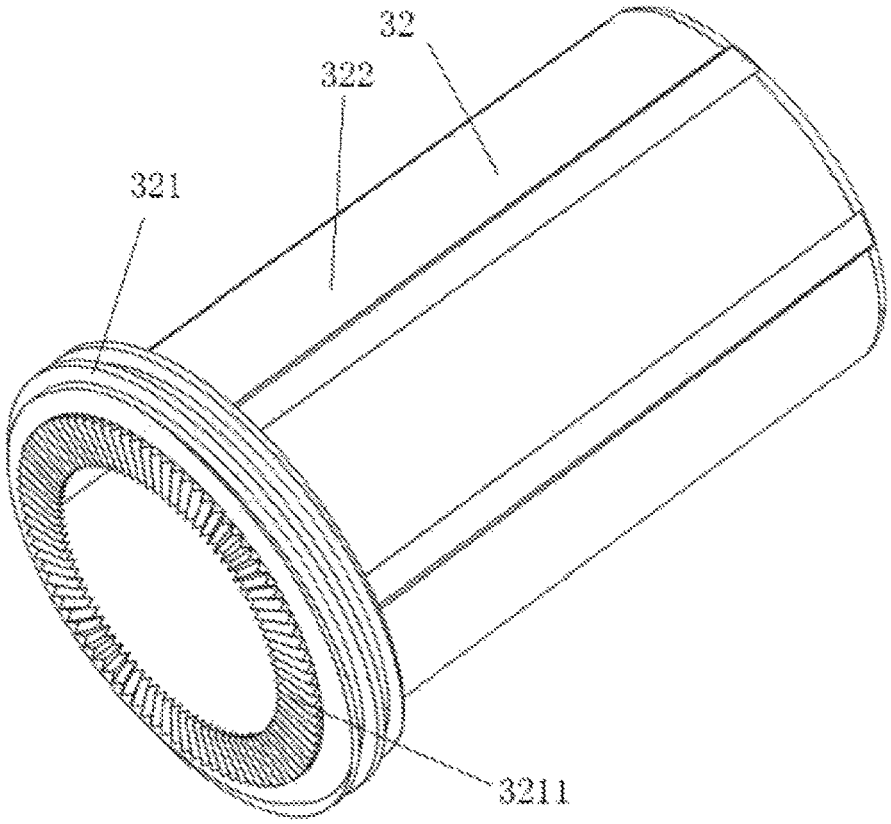
FIG. 7 is a schematic diagram showing the outer bush in FIG. 5.

In some embodiments, as shown in FIG. 7, the outer bush is a hollow sleeve shaped like a ladder. A first section with greater diameter is a retainer ring 321, and a second section with smaller diameter is the bush body 322. The bush body 322 is inserted into one end of the tail part 2. The retainer ring 321 is located outside the tail part 2. An end face of the retainer ring 321 is provided with a retainer ring teeth 3211. An end face of the intermediate teeth 34 facing the retainer ring 33 is provided with an intermediate teeth 342. An external thread is provided on the outer surface of the retainer ring 321 for connecting with the lock bush 33.

In some embodiments, as shown in FIG. 8, a notch 343 is provided on the intermediate bush 34. The notch 343 plays a role of shrinking and expanding, and is suitable for the second diameter sleeves 312 with different outer diameters.

In some embodiments, as shown in FIG. 5, the pipe connection assembly 3 further comprises a head block 35 and a tail block 36. The head block 35 is inserted into one end of the head part 1 away from the bushing member 5. The first diameter bush 311 is connected to the head part 1 passing through the head block 35. The tail block 36 is inserted into one end of the tail part 2. The bush body 322 is connected to the tail body 2 passing through the tail block 36. The arrangement of the head block 35 and the tail block 36 facilitates the connection between the first diameter bush 311 and the head part 1, and the connection between the bush body 322 and the tail part 2.

Figure 10:
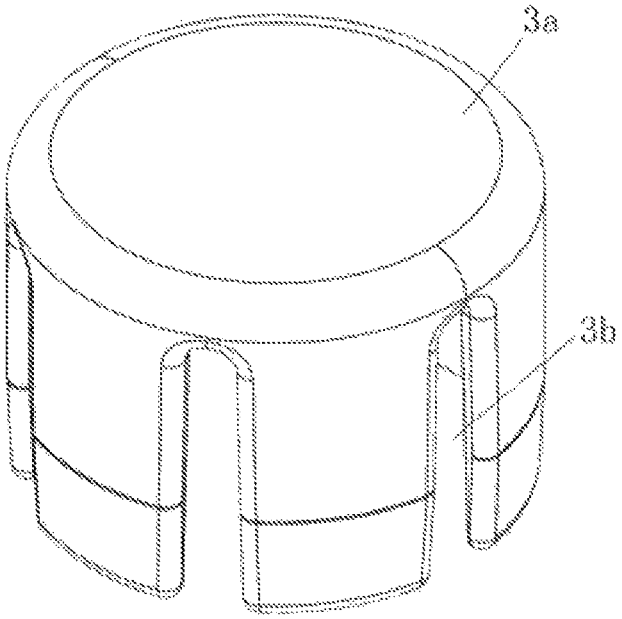
FIG. 10 is a schematic diagram showing the head block and the tail block in FIG. 5.

In some embodiments, as shown in FIG. 10, the head block 35 are structurally identical to the tail block 36, both of which are hollow cylinders. A plurality of shrinking notch **3*b* are evenly arranged on a side wall of the block body 3*a*. The head block 35 may be assembled to the head part 1 in the form of interference fit. The tail block 36 may be assembled to the tail part 2** in the form of interference fit.

Preferably, the first diameter 311 and the head block 35 are in thread connection. The bush body 322 and the tail block 36 are in thread connection.

Preferably, the length of the lock bush 33 is greater than the sum of the length of the intermediate bush 34 and the width of the retainer ring 321. A sealing ring (not shown) is provided between the lock bush 33 and the intermediate bush 34.

In some embodiments, as shown in FIGS. 11-16, the tool bar further comprises a shank 6 and a shank installation assembly 7. The shank installation assembly 7 comprises a nut seat 71, a stop seat 72 and a screw 73.

Figure 12:
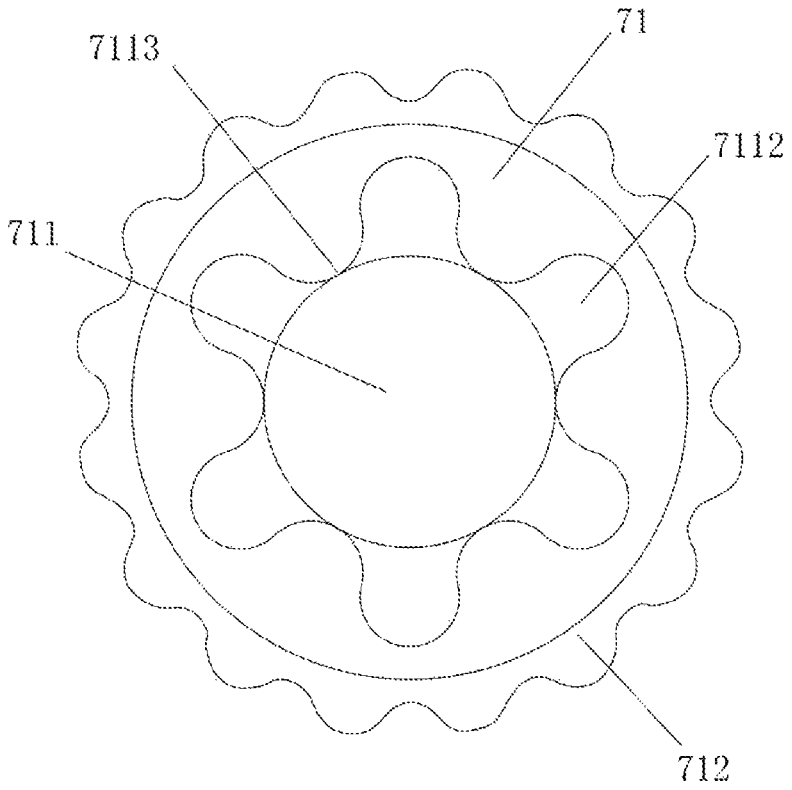
FIG. 12 is a schematic diagram showing the nut seat in FIG. 11.
Figure 13:
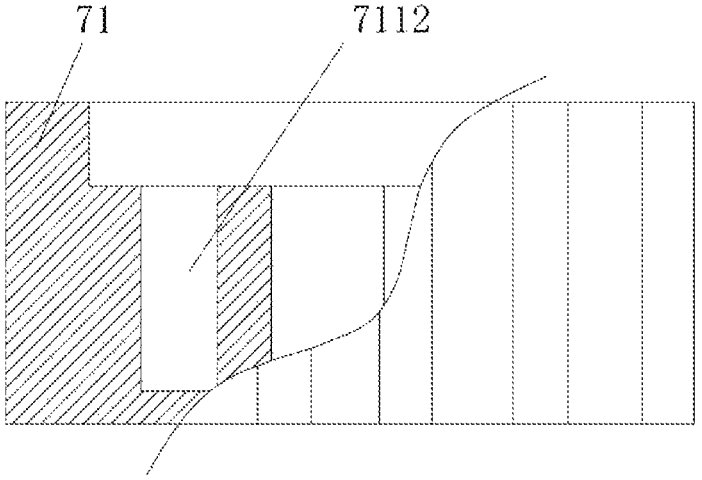
FIG. 13 is a schematic diagram showing the partial cross-sectional view of the nut set in FIG. 11.

As shown I FIGS. 12-13, the nut seat 71 is a structure with a blind hole in the center.

A groove structure 711 which has clubs-shaped cross section is provided on a bottom center of the blind hole. The groove wall of the groove structure 711 comprises an arc groove section 7112 recessed radially outward and a curved convex section 7113 protruding radially inward. The arc groove section 7112 is matched with the curved convex section 7113.

Figure 11:
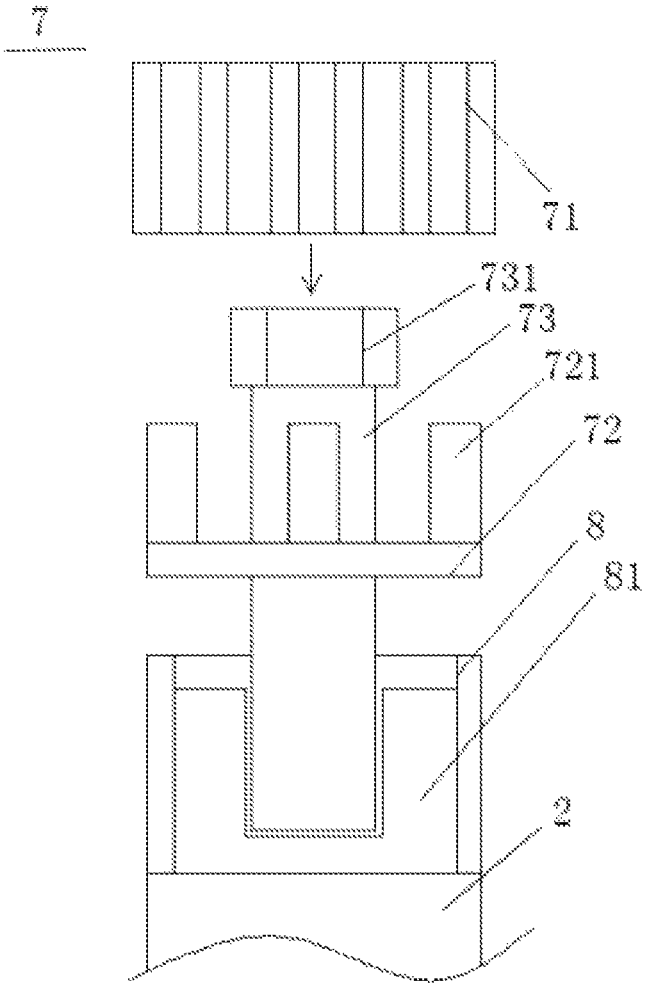
FIG. 11 is an exploded view of the shank installation assembly of the tool bar according to one embodiment of the present disclosure.
Figure 14:
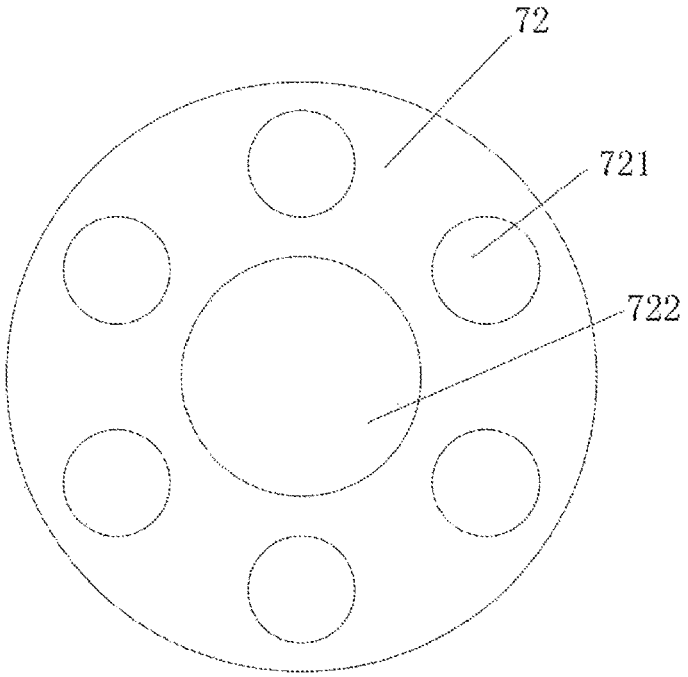
FIG. 14 is a schematic diagram showing the stop seat in FIG. 11.

As shown in FIGS. 11 and 14, the stop seat 72 is a circular sheet. A plurality of stop pillars 721 are arranged on a bottom surface of the stop seat 72. Each of the stop pillar 721 is matched with the arc groove section 7112. A through hole 722 is provided on the center of the stop seat 72.

One end of the screw 73 is provided with thread, the other end with a nut 731.

The screw 73 is located on the stop seat 72 passing through the through hole 722. The nut 731 of the screw 73 is inserted into the center of the groove structure 711. The stop pillar 721 on the stop seat 72 is inserted into the arc groove section 7112. The stop seat 72 limits the nut within the groove structure 711. The thread end of the screw 73 passes through the shank 6 and is connected to one end of the tail part 2 away from the pipe connection assembly 3 to achieve the connection between the shank 6 and the tail part 2. By this arrangement, the shank 6 and the tail part 2 are in a solid connection with convenient quick release. The connection is strong and provide longer service life. The connection also avoids the shank 6 loose from the tail part 2 which may significantly affect the work efficiency.

In some embodiments, as shown in FIG. 12, a skidproof pattern 712 is provided on the outer surface of the nut seat 71. In the present embodiments, the skidproof pattern is a wavy surface.

The number, shape, length of the stop pillar 721 is corresponding to the number, shape and depth of the arc groove section 7112. The stop pillar 721 plays a role for limitation and support. One face of the stop seat 72 facing the blind hole of the nut seat 71 is closely jointed with the bottom wall of the blind hole.

In some embodiments, the stop pillar 721 is glued with the arc groove section 7112. A side wall of the screw nut 731 is glued and secured with the curved convex section 7113.

Figure 15:
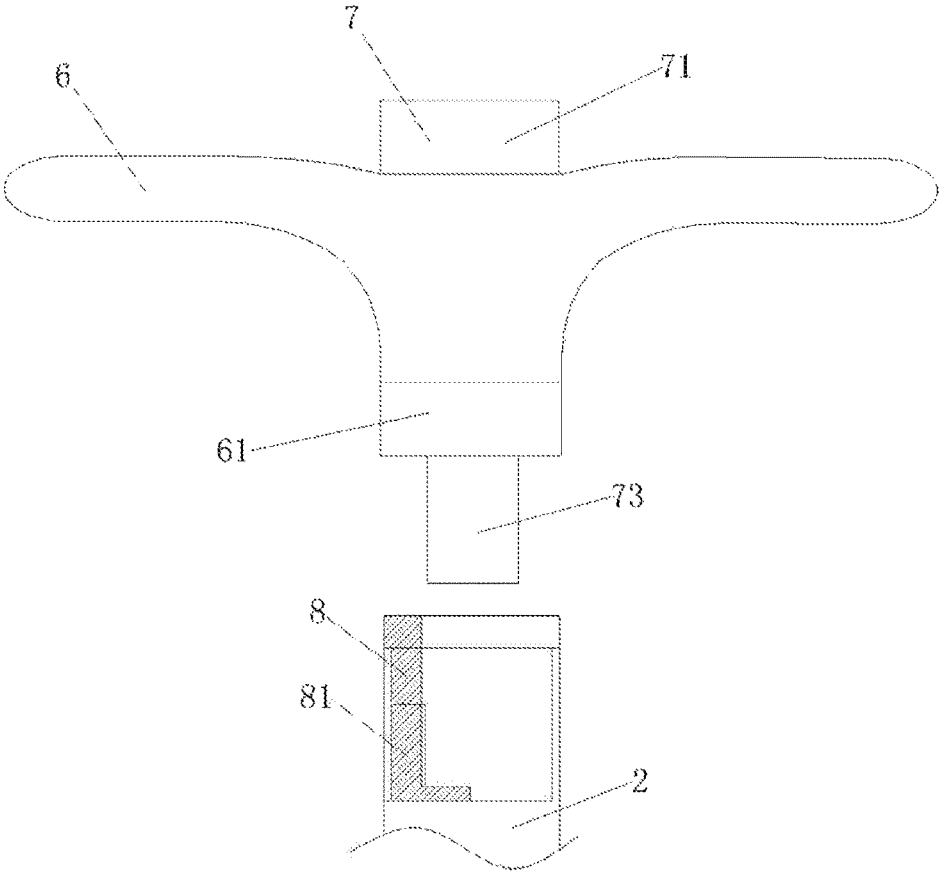
FIG. 15 is an exploded diagram showing the shank installed on the tail part of the shank installation assembly according to one embodiment of the present disclosure.
Figure 16:
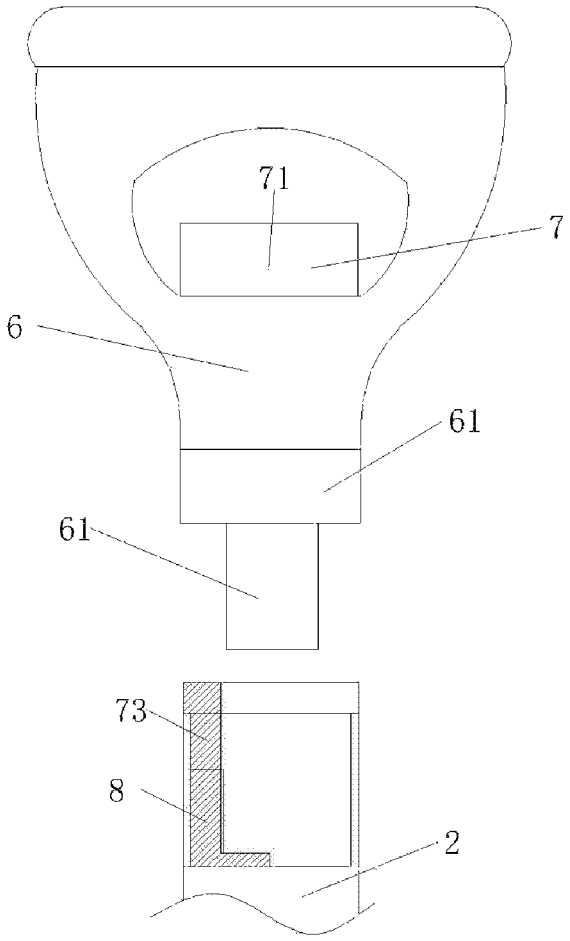
FIG. 16 is an exploded diagram showing the shank installed on the tail part of the shank installation assembly according to another embodiment of the present disclosure.

In some embodiments, as shown in FIGS. 15 and 16, the tool bar further comprises a stop bush 8. The stop bush 8 is located on one end of the tail part 2 away from the pipe connection assembly 3. A anti-retraction ring 61 is provided at a lower part of the shank 6. Both the end face of the anti-retraction ring 61 facing the stop bush 8 and the end face of the stop bush 8 facing the anti-retraction ring 61 are provided with a anti-retraction teeth (not shown) which is able to couple with each other. The thread end of the screw 73, in sequence, passes through the shank 6 and the anti-retraction ring 61 to connect to the stop bush 8. The anti-retraction teeth may be oblique teeth or straight teeth, which can prevent retraction.

In some embodiments, as shown in FIGS. 15, and 16, a stop nut 81 is provided within the stop bush 8. The thread end of the screw 73 is connected to the stop nut 81.

In some embodiments, as shown in FIGS. 15, and 16, then shank 6 may be T-shaped, or triangular.

When the shank 6 is T-shaped, an upper end of the screw 73 downwardly passes the sleeve (not shown) and secure with the stop nut 81.

When the shank 6 is triangular, a horizontal side is the handshake. The two other sides are support sides. The two sides are secured to the shank sleeve. The screw 73 is inserted into the shank sleeve downward from the hollow part of the triangular structure, and then secured to the stop nut 81 after passing through shank sleeve.

The above descriptions are only preferred embodiments of the present disclosure and are not intended to limit the present invention. Any modification, equivalent replacement and improvement made within the spirit and principle of the present disclosure shall be deemed in the protection of the present invention.

What is claimed is:

1. A tool bar, comprising a head part, a tail part, a pipe connection assembly, a backstop mechanism and a bushing member; the head part and the tail part are connected with each other by the pipe connection assembly;

the bushing comprises a cone section and a cylinder section; one end of the head part passes through the cylinder section and connected to an inner thread of the cone section; the outer side of the cone section is configured to secure with a tool head; an external thread is provided on an outer surface of the cylinder section;

the backstop mechanism comprises an intermediate member and a lock cap; the intermediate member is a hollow cylinder;

the lock cap is a hollow cylindrical structure, with an internal thread provided on an inner wall of the lock cap at one end, and a shoulder provided at an end mouth on the other end;

the intermediate member is fitted into an interior of the lock cap; the intermediate member and the lock cap together are fitted over the head part; the intermediate member tightly abuts against an outer surface of the head part; the internal thread on the lock cap is coupled with the external thread on the cylinder section; the shoulder abuts against an outer end face of the intermediate member;

the pipe connection assembly comprises an inner bush, an outer bush, a lock bush and an intermediate bush;

the inner bush comprises a first diameter bush and a second diameter bush, wherein the first diameter bush has a greater diameter than the second diameter bush; the first diameter bush is connected to one end of the bushing member away from the head part; one end of the outer bush is connected to one end of the tail part;

the intermediate bush is fitted over the second diameter bush; the outer bush is fitted over the second diameter bush; an end face of the outer bush is jointed with an end face of the intermediate bush; the lock bush is fitted over the intermediate bush and the outer bush; an end of the lock bush is connected to the outer bush by thread connection; a stop collar is provided on the intermediate of the inner wall of the lock bush; when the lock bush is fitted over the intermediate bush and the outer bush, the stop collar is located between the intermediate bush and the first diameter bush;

both the bushing member and the inner bush are solid members acting as extensions;

a stop step is provided on an inner surface of the intermediate member; a plurality of open notches are provided on a side wall of the intermediate member; the open notches are spaced along the circumference of the side wall of the intermediate member and extend from the end to the center; a plurality of elongate planes are provided on the outer surface of the head part corresponding to the intermediate member; the elongate plane is matched with the stop step;

a first teeth is provided on an outer end face of the cylinder section facing toward the intermediate member along the circumference of the cylinder section; a second teeth is provided on an inner end face of the intermediate member facing toward the cylinder section; the lock cap is thread connected with the cylinder section; and the second teeth is coupled with the first teeth.

2. The tool bar according to claim 1, wherein the lock nut is secured within the cone section; one end of the head part passes through the cylinder section and secured with the lock nut.

3. The tool bar according to claim 2, wherein a metal sleeve is fitted over the bushing member; a shape of the metal sleeve is matched with the bushing member.

* * * * *